United States Patent [19]

Calderazzo

[11] 3,969,992

[45] July 20, 1976

[54] METHOD OF FASTENING SHEET MATERIAL

[75] Inventor: Franklin J. Calderazzo, Norwalk, Conn.

[73] Assignee: Pitney-Bowes, Inc., Stamford, Conn.

[22] Filed: Dec. 4, 1975

[21] Appl. No.: 637,692

[52] U.S. Cl. ..... 93/1.1; 156/253

[51] Int. Cl.[2] ..... B31F 5/02

[58] Field of Search ..... 93/1.1, 1 R; 156/91, 156/92, 253, 513

[56] References Cited

UNITED STATES PATENTS

| | | | |
|---|---|---|---|
| 1,174,069 | 3/1916 | Hosford | 156/253 X |
| 1,324,103 | 12/1919 | Cone | 93/1.1 |
| 1,958,455 | 5/1934 | Ware | 156/253 X |
| 2,020,668 | 11/1935 | Wandel | 93/1.1 X |
| 3,233,526 | 2/1966 | Sherman | 93/1.1 |
| 3,810,809 | 5/1974 | Herd et al. | 156/513 X |

*Primary Examiner*—James F. Coan

*Attorney, Agent, or Firm*—William D. Soltow, Jr.; Albert W. Scribner; Robert S. Salzman

[57] ABSTRACT

A method of providing an improved mechanical bond when fastening a plurality of paper sheets together. The body of sheet material is punched or cut through to form a flap. The flap is then folded over upon the body of sheets, and the flap and body of sheets are simultaneously crimped. A superior mechanical bond is formed, because three separate bonds are made; the body of sheets are fastened together, the layers of the flap are fastened together, and the body of sheets is fastened to the flap.

10 Claims, 5 Drawing Figures

FIG. 1
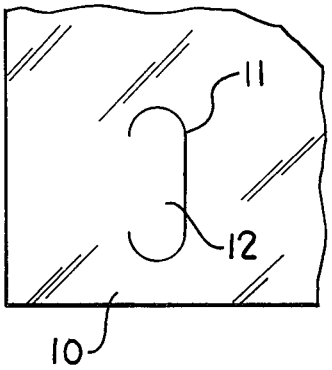
FIG. 2
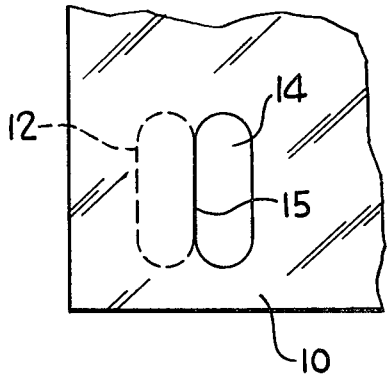
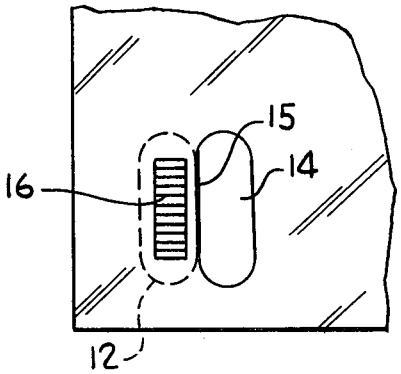
FIG. 3a
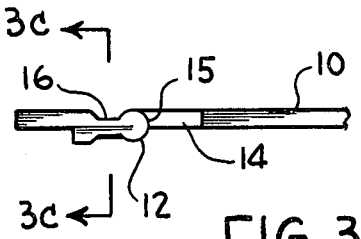
FIG. 3b
FIG. 3c
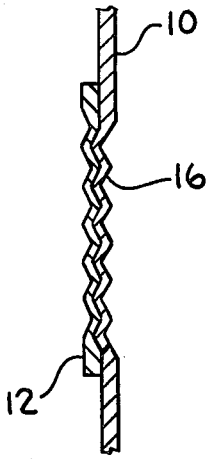

METHOD OF FASTENING SHEET MATERIAL

The invention pertains to a method of mechanically fastening or bonding sheet material, and more particularly to a method of perforating, folding and crimping a plurality of sheets to form a unitized bonded mass of sheet material.

BACKGROUND OF THE INVENTION

Heretofore, it has been known to form a multilayered flap in a corner of a body of sheet material, and to fold this flap back upon the body of the sheet material. Usually, the flap is mechanically pressed against the body of sheets as it is folded thereupon. Patents showing this method are numerous:

F. L. Gregory, U.S. Pat. No. 689,394, issued Dec. 24, 1901;

E. L. Miller, U.S. Pat. No. 1,302,920, issued June 17, 1919;

A. Nassano, U.S. Pat. No. 1,387,164, issued Aug. 9, 1921;

H. A. W. Wood, U.S. Pat. No. 2,107,462, issued Feb. 8, 1938;

H. J. Jewell, U.S. Pat. No. 2,749,816, issued June 12, 1956;

J. P. Thor, U.S. Pat. No. 2,874,666, issued Feb. 24, 1959; and

R. A. Sherman, U.S. Pat. No. 3,233,526, issued Feb. 8, 1966.

While the above methods of fastening the sheets of paper together are generally adequate, they do not provide as strong a bond as when using a mechanical fastener such as a clip, staple, or pin, etc.

This invention was conceived as a way to provide a superior mechanical paper bond in a plurality of sheets, which will more nearly approach the bond strength of a mechanical fastening of the paper, than prior paper bonded methods.

SUMMARY OF THE INVENTION

The sheet fastening method of this invention comprises: First, supporting a plurality of sheets of material as a unitized body for the purpose of fastening the sheets. Next, a multilayered flap is formed in a corner section of the sheet body by means of cutting, shearing, or otherwise perforating through the sheets of material. This flap is then folded back upon the body of the sheets, and both the flap and sheet body are crimped by pressing-in undulations to provide a triple bond: (a) the layers of the flap are bonded together; (b) the sheets of the body of material are bonded together opposite the flap; and (c) the flap is bonded to the body of sheet material.

Although it is preferable to crimp the flap and the body of sheets in a simultaneous operation, it is also possible within the limits of this invention to crimp the flap and body of sheets separately prior to folding, and then mechanically bonding the flap to the body of sheets. Still another variation to the above described method would also be to: crimp the body of material, form a flap about the crimp area, fold the flap upon the body and crimp the flap to the body of sheets.

It is an object of this invention to provide an improved sheet fastening method or methods; and It is a further object of this invention to provide a sheet bonding method providing a superior paper fastening bond.

These and other objects of the invention will be better understood and will become more apparent with reference to the following detailed description, taken in conjunction with the accompanying drawings, in which:

FIG. 1 is a top view of a corner of a plurality of sheets arranged as a unitized body of material, with a flap having been formed in the body by a perforating tool;

FIG. 2 is a top view of the body of material of FIG. 1, with the flap folded underneath the body of material; and FIGS. *3a*, *3b* and *3c*, respectively, show top side and sectional views of the body of material of FIG. 2, with the flap and body of material having received a crimp in order to bond them together.

DETAILED DESCRIPTION

Generally speaking, this invention is for a method of mechanically bonding a plurality of sheets of material so as to form a unitized body of sheets. The sheets of material are supported as a unitized mass. Next, the mass of sheets is perforated (cut, sheared, etc.) to form a multilayered flap. Then the flap is folded upon the mass of sheets, and the flap and mass of sheets are given a crimp by pressing-in undulations. This crimping accomplishes three separate, but interdependent bonds: (a) the layers of the flap are fastened together; (b) the sheets of the mass of sheets are bonded together; and (c) the flap is fastened to the body of the sheet mass.

Now referring to FIG. 1, a plurality of sheets of material 10, such as paper, is shown having received a perforation 11 therethrough, in a corner portion of the sheet mass. This perforation 11 is designed to form a flap 12 (see FIG. *3b*) which is folded back upon the body of the material.

When the flap 12 is folded along fold line 15, and tucked under the body of sheets 10, it leaves a hole 14 as shown in FIG. 2.

The flap 12 and the body of sheets 10 are then given a crimp 16 by pressing-in undulations as shown in FIGS. *3a*, *3b* and *3c*.

The body of sheets 10 is now securely fastened in its corner portion.

The steps of the method are easily performed by standard crimping, cutting, and forming tools known in the art.

The drawings of this invention are deemed to be merely exemplary in nature, with the shape and configurations of the holes, flaps and crimps considered as designers choice.

All modifications and changes which are apparent to those skilled in this art are deemed to fall within those limits defining the invention, as presented by the appended claims.

What is claimed is:

1. A method of mechanically bonding a plurality of sheets of material so as to form a unitized body of sheets, comprising the steps of:

a. supporting as a unitized mass, a plurality of sheets of material for the purpose of mechanically bonding said sheets together;

b. perforating said mass of sheet material so as to form a multilayered flap in said mass of sheets;

c. folding said multilayered flap upon said mass of sheets; and d. simultaneously crimping said multilayered flap and said mass of sheets by pressing-in undulations so as to form a mechanical bond in the mass of sheets, in the multilayered flap, and between the multilayered flap and said mass of sheets, so as to form a unitized body of sheets.

2. The method of mechanically bonding sheets of material of claim 1, wherein said sheets of material are paper.

3. The method of mechanically bonding sheets of material of claim 1, wherein said flap is folded underneath said mass of sheets.

4. The method of mechanically bonding sheets of material of claim 1, wherein the perforating of the mass of sheets is accomplished by cutting through said sheets.

5. The method of mechanically bonding sheets of material of claim 1, wherein the perforating of the mass of sheets is accomplished by shearing through said sheets.

6. A method of mechanically fastening a plurality of sheets of material together, comprising the steps of:

a. supporting as a unitized body, a plurality of sheets of material for the purpose of mechanically fastening said body of sheets together;

b. perforating said body of sheets of material so as to form a multilayered flap in said sheets;

c. folding said multilayered flap upon said body of sheets; and d. crimping said multilayered flap and said body of sheets, so as to form a mechanical fastening by pressed-in undulations in the body of sheets of material, in the multilayered flap, and between the multilayered flap and said body of sheet material.

7. The method of mechanically fastening sheets of material of claim 6, wherein said crimping of the body of sheets, the flap, and between the flap and the body of sheets is simultaneously accomplished.

8. The method of mechanically fastening sheets of material of claim 6, wherein said flap is folded underneath said body of sheets.

9. The method of mechanically fastening sheets of material of claim 6, wherein the perforating of the body of sheets is accomplished by cutting through said sheets.

10. The method of mechanically fastening sheets of material of claim 6, wherein the perforating of the body of sheets is accomplished by shearing through said sheets.

* * * * *